US012630382B2

(12) United States Patent
Inoue et al.

(10) Patent No.: US 12,630,382 B2
(45) Date of Patent: May 19, 2026

(54) SHEET FEEDING APPARATUS AND IMAGE FORMING APPARATUS

(71) Applicant: CANON KABUSHIKI KAISHA, Tokyo (JP)

(72) Inventors: Seita Inoue, Chiba (JP); Akihiro Kawakita, Chiba (JP); Teruhito Kai, Chiba (JP); Hiroaki Tomiyasu, Ibaraki (JP); Tatsuo Fujimura, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 5 days.

(21) Appl. No.: 18/591,315

(22) Filed: Feb. 29, 2024

(65) Prior Publication Data

US 2024/0300762 A1 Sep. 12, 2024

(30) Foreign Application Priority Data

Mar. 8, 2023 (JP) ..... 2023-035593

(51) Int. Cl.
*B65H 7/16* (2006.01)
*B65H 3/46* (2006.01)

(52) U.S. Cl.
CPC ..... *B65H 7/16* (2013.01); *B65H 3/46* (2013.01); *B65H 2405/115* (2013.01)

(58) Field of Classification Search
CPC ..... B65H 7/16; B65H 3/46; B65H 2405/115; B65H 3/08
See application file for complete search history.

(56) References Cited

U.S. PATENT DOCUMENTS

2009/0218749 A1* 9/2009 Shingai ..... B65H 31/02 271/3.14
2021/0171301 A1* 6/2021 Hirai ..... B65H 5/30

FOREIGN PATENT DOCUMENTS

JP H0423747 A 1/1992

* cited by examiner

*Primary Examiner* — Thomas A Morrison
(74) *Attorney, Agent, or Firm* — ROSSI, KIMMS & McDOWELL LLP

(57) ABSTRACT

A sheet feeding apparatus includes an opening and closing portion including a supporting portion, the opening and closing portion configured to move to a closed position and to an opened position that is a sheet feeding position, a sheet feeding portion, an opening and closing detection portion configured to detect the sheet feeding position, a separating portion configured to blow air toward the plurality of sheets supported on the supporting portion to separate the sheets, and a control portion configured to execute a separating mode of performing an air blowing operation by the separating portion in feeding the sheets by the sheet feeding portion. In the separating mode, the control portion is configured to stop the air blowing operation in a case where movement of the opening and closing portion from the sheet feeding position toward the closed position has been detected by the opening and closing detection portion.

10 Claims, 14 Drawing Sheets

SHEET FEEDING APPARATUS AND IMAGE FORMING APPARATUS

BACKGROUND OF THE INVENTION

Field of the Invention

The present invention relates to a sheet feeding apparatus and an image forming apparatus having a separating portion that blows air to and separates a plurality of sheets supported on a supporting portion manually.

Description of the Related Art

Image forming apparatuses such as copying machines, facsimiles, and printers are equipped with manual feed trays and sheet feed cassettes, or sheet feed decks attached externally thereto, as sheet feeding apparatuses for feeding sheets to image forming portions to form images on sheets. Further, there are increasing demands for forming images on various types of sheets, and sheets having smooth surfaces, such as coated paper, may be used. If a sheet bundle of such sheets having smooth surfaces is set to sheet feeding apparatuses such as those described above, the sheets may not be separated due to the high adhesion between sheets, and feeding failures may occur. Therefore, an apparatus is proposed in which air is blown toward the sheet bundle being set to cause the sheets to float and be separated, which is so-called air separating (refer for example to Japanese Patent Application Laid-Open Publication No. H04-023747).

In the image forming apparatus, the manual feed tray on which sheets are set manually by users is opened toward an outer side from the apparatus body before the sheets are set, and the user may come into contact with the tray. If the user comes into contact with the manual feed tray when the sheets are fed while air separating is performed, the position of the sheets that are floated by air separating may be misaligned. If such sheets with a misaligned position is fed, skew feed may occur and jamming of sheets may be caused.

SUMMARY OF THE INVENTION

According to one aspect of the present invention, a sheet feeding apparatus includes an opening and closing portion including a supporting portion configured to support a plurality of sheets being set manually, the opening and closing portion configured to move to a closed position closed with respect to an apparatus body and to an opened position opened with respect to the apparatus body, that is a sheet feeding position where the sheets supported on the supporting portion can be fed, a sheet feeding portion configured to feed the sheets supported on the supporting portion, an opening and closing detection portion configured to detect the sheet feeding position, a separating portion configured to blow air toward the plurality of sheets supported on the supporting portion to separate the sheets, and a control portion configured to execute a separating mode of performing an air blowing operation by the separating portion in feeding the sheets by the sheet feeding portion. In the separating mode, the control portion is configured to stop the air blowing operation in a case where movement of the opening and closing portion from the sheet feeding position toward the closed position has been detected by the opening and closing detection portion.

Further features of the present invention will become apparent from the following description of exemplary embodiments with reference to the attached drawings.

BRIEF DESCRIPTION OF THE DRAWINGS

FIG. 6 is a cross-sectional side view illustrating the manual sheet feed portion in a state where a lifting plate detection sensor is ON.

DESCRIPTION OF THE EMBODIMENTS

First Embodiment

Figure 1:
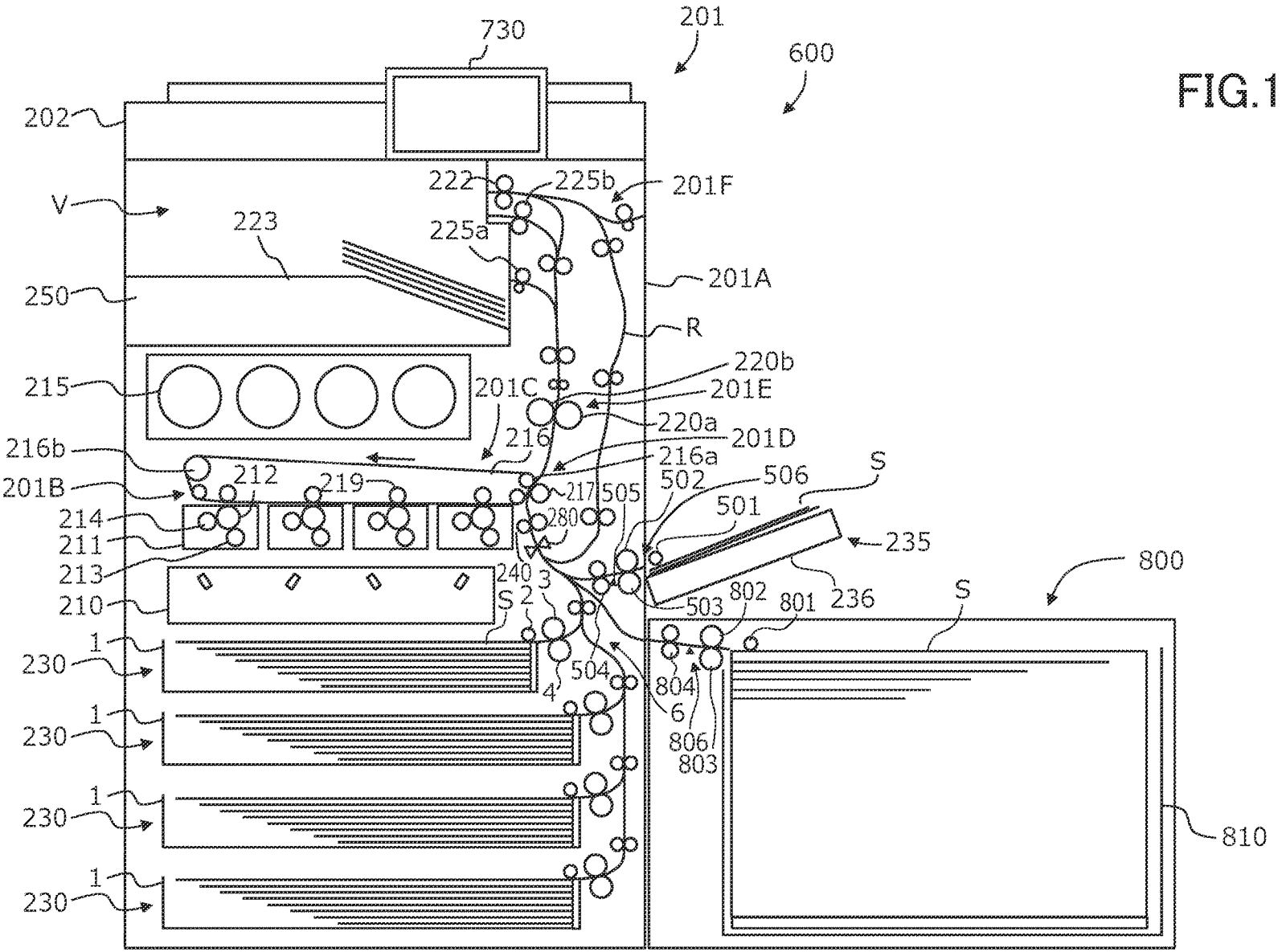
FIG. 1 is a view illustrating a general configuration of an image forming system according to a first embodiment.

A first embodiment according to the present invention will be described in detail below with reference to the drawings. At first, an image forming system 600 including an image forming apparatus 201 and a manual sheet feed portion 235 serving as a sheet feeding apparatus connected thereto will be described with reference to FIG. 1. FIG. 1 is a view illustrating a general configuration of the image forming system according to the first embodiment.

General Configuration of Image Forming System

As illustrated in FIG. 1, the image forming system 600 includes the image forming apparatus 201, the manual sheet feed portion 235, and a sheet feed deck 800 connected to the image forming apparatus 201. The sheet feed deck 800 is connected to a right side of the image forming apparatus 201 in FIG. 1 and is configured to feed sheets S to the image forming apparatus 201. Further, the manual sheet feed portion 235 is also configured to feed sheets S to the image forming apparatus 201.

General Configuration of Image Forming Apparatus

As illustrated in FIG. 1, the image forming apparatus 201 includes an apparatus body 201A having an image forming portion 201B for forming images on sheets. Further, an image reading apparatus 202 arranged approximately horizontally is disposed on an upper portion of the apparatus body 201A. Further, a sheet discharge space V for discharging sheets is formed between the image reading apparatus 202 and the apparatus body 201A. Further, an operation portion 730 which is a User Interface (UI) configured of a touch panel capable of displaying a screen, for example, is arranged on an upper portion of the apparatus body 201A.

The image forming portion 201B is a four-drum full-color system. The image forming portion 201B includes a laser scanner 210, four process cartridges 211Y, 211M, 211C, and 211K for forming toner images of four colors, which are yellow (Y), magenta (M), cyan (C) and black (K). Each process cartridge 211 is equipped with a photosensitive drum 212, a charging unit 213 serving as a charging device, and a developing unit 214 serving as a developing device. Further, the image forming portion 201B includes an intermediate transfer unit 201C arranged above the process cartridges 211, and a fixing portion 201E. Further, a toner cartridge 215 for supplying toner to the developing unit 214 is disposed above the intermediate transfer unit 201C.

The intermediate transfer unit 201C includes an intermediate transfer belt 216 wound around a driving roller 216*a* and a tension roller 216*b*. Primary transfer rollers 219 that are in contact with the intermediate transfer belt 216 at positions opposed to the photosensitive drums 212 are disposed on an inner side of the intermediate transfer belt 216. The intermediate transfer belt 216 is rotated in the arrow direction by the driving roller 216*a* that is driven by a driving unit not shown.

Then, toner images of respective colors having negative polarity on the photosensitive drums are sequentially transferred in multiple layers on the intermediate transfer belt 216 by the primary transfer rollers 219. A secondary transfer roller 217 for transferring the color image formed on the intermediate transfer belt onto a sheet S is disposed at a position opposed to the driving roller 216*a* of the intermediate transfer unit 201C. A secondary transfer portion 201D is formed between the intermediate transfer belt 216 and the secondary transfer roller 217. Further, the fixing portion 201E having a pressure roller 220*a* and a heating roller 220*b* is arranged above the secondary transfer roller 217. Further, a first sheet discharge roller pair 225*a*, a second sheet discharge roller pair 225*b*, and a duplex reverse portion 201F are arranged above the fixing portion 201E. The duplex reverse portion 201F is provided with a reverse conveyance roller pair 222 capable of rotating in normal and reverse directions, and a reconveyance path R for conveying the sheet having an image formed on a first side thereof again to the image forming portion 201B.

A plurality of sheet feed units 230 for feeding the sheets S set therein to the image forming portion 201B are disposed at a lower portion of the apparatus body 201A. Each of the plurality of sheet feed units 230 is equipped with a feeding cassette 1 storing a plurality of sheets, or a sheet bundle, and a sheet feeding portion 6 serving as a feeding portion for feeding the sheets S stored in the feeding cassette 1. The sheet feeding portion 6 is equipped with a pickup roller 2, and a feed roller 3 and a retard roller 4 serving as a separation unit for separating the sheets S that have been conveyed by the pickup roller 2 and fed in a multi-feed manner.

Further, the sheet feed deck 800 for sending the sheets S being set therein toward the image forming portion 201B is disposed on a right side of the apparatus body 201A in FIG. 1 and below the manual sheet feed portion 235. The sheet feed deck 800 is equipped with a sheet feeding portion 806, similarly as the sheet feed units 230. That is, the sheet feeding portion 806 is equipped with a pickup roller 801, and a feed roller 802 and a retard roller 803 serving as a separation unit for separating the sheets S that have been conveyed by the pickup roller 801 and fed in a multi-feed manner. Further, a drawing roller pair 804 is disposed downstream of the sheet feeding portion 806 in the sheet conveyance direction.

Further, the manual sheet feed portion 235 for feeding a sheet S from a plurality of sheets S, i.e., sheet bundle, set manually toward the image forming portion 201B is provided on a right side of the apparatus body 201A in FIG. 1. The manual sheet feed portion 235 is a so-called manual feed tray, and includes a sheet feed tray 236 serving as an opening and closing portion. The sheet feed tray 236 is capable of pivoting and moving in an opening and closing direction with respect to the apparatus body 201A, that is, it is disposed in a switchable manner between an opened state where it is opened with respect to the apparatus body 201A and a closed state where it is closed with respect to the apparatus body 201A. That is, the sheet feed tray 236 is configured to enable the sheet S to be supported in the opened state. In other words, the sheet feed tray 236 is an opening and closing portion capable of moving between a closed position where it is closed with respect to the apparatus body 201A and an opened position where it is opened with respect to the apparatus body 201A and which is a feeding position capable of feeding the sheets supported on the supporting portion.

Further, the manual sheet feed portion 235 is equipped with a sheet feeding portion 506, similar to the sheet feed units 230. That is, the sheet feeding portion 506 is equipped with a pickup roller 501, and a feed roller 502 and a retard roller 503 serving as a separation unit for separating the sheets S having been conveyed by the pickup roller 501 and fed in a multi-feed manner. Further, a draw-out roller pair 504 is provided downstream of the sheet feeding portion 506 in the sheet conveyance direction.

Further, a media detection sensor 280 serving as a sheet type detection portion, which detects a grammage or a surface property of the sheet by sensing the sheet S being conveyed, is arranged on the conveyance path of the apparatus body 201A.

Operation of Image Forming Apparatus

Next, an image forming operation of the image forming apparatus 201 will be described. At first, for example, if an image information of a document is read by the image reading apparatus 202, the image information is subjected to image processing, converted into electric signals, and transmitted to the laser scanner 210 of the image forming portion 201B. The image information may also be transmitted through a network from a host device 1500 (refer to FIG. 2) such as an external computer.

In the image forming portion 201B, surfaces are charged uniformly to a predetermined polarity and potential by the charging units 213, and the surfaces of the photosensitive drums 212 are sequentially exposed by laser light. Thereby, yellow, magenta, cyan, and black electrostatic latent images are sequentially formed on the photosensitive drums of the respective process cartridges 211.

Thereafter, the electrostatic latent images are developed using color toners and visualized, and the toner images of respective colors formed on the photosensitive drums are sequentially transferred by primary transfer biases applied to the primary transfer rollers 219 onto the intermediate transfer belt 216 in a superposed manner. Thereby, a toner image is formed on the intermediate transfer belt 216.

Meanwhile, the sheet S fed from the sheet feed units 230, or the manual sheet feed portion 235, or the sheet feed deck 800, is conveyed to a registration roller pair 240 composed of a driving roller and a driven roller. In this state, the drive of the registration roller pair 240 is stopped and a leading edge of the sheet S is abutted against the registration roller pair 240. Thereby, the leading edge of the sheet S is aligned on the registration roller pair 240.

Thereafter, by continuing conveyance of the sheet S by the feed roller 3, or the feed roller 502, or the feed roller 802, a deflection, or loop, is formed on the sheet S. Thereafter, the registration roller pair 240 is driven at a matched timing with the toner image on the intermediate transfer belt 216. Thereby, skewing of the sheet S is corrected by the registration roller pair 240, and the sheet S subjected to skew correction is conveyed by the registration roller pair 240 to the secondary transfer portion 201D.

Successively, in the secondary transfer portion 201D, the toner image is collectively transferred onto the sheet S by a secondary transfer bias applied to the secondary transfer roller 217. Then, the sheet S having the toner image transferred thereto is conveyed to the fixing portion 201E and subjected to heat and pressure at the fixing portion 201E, by which the toner of respective colors is melted and mixed, and fixed as a color image on the sheet S.

Thereafter, the sheet S to which the image is fixed is discharged into the sheet discharge space V by the first sheet discharge roller pair 225*a* or the second sheet discharge roller pair 225*b* disposed downstream of the fixing portion 201E, where it is supported on a supporting portion 223 formed at a bottom of the sheet discharge space V. When forming images on both sides of the sheet S, after the image has been fixed, the sheet S is conveyed by the reverse conveyance roller pair 222 to the reconveyance path R, and then conveyed again to the secondary transfer portion 201D.

Configuration of Manual Sheet Feed Portion

Figure 3:
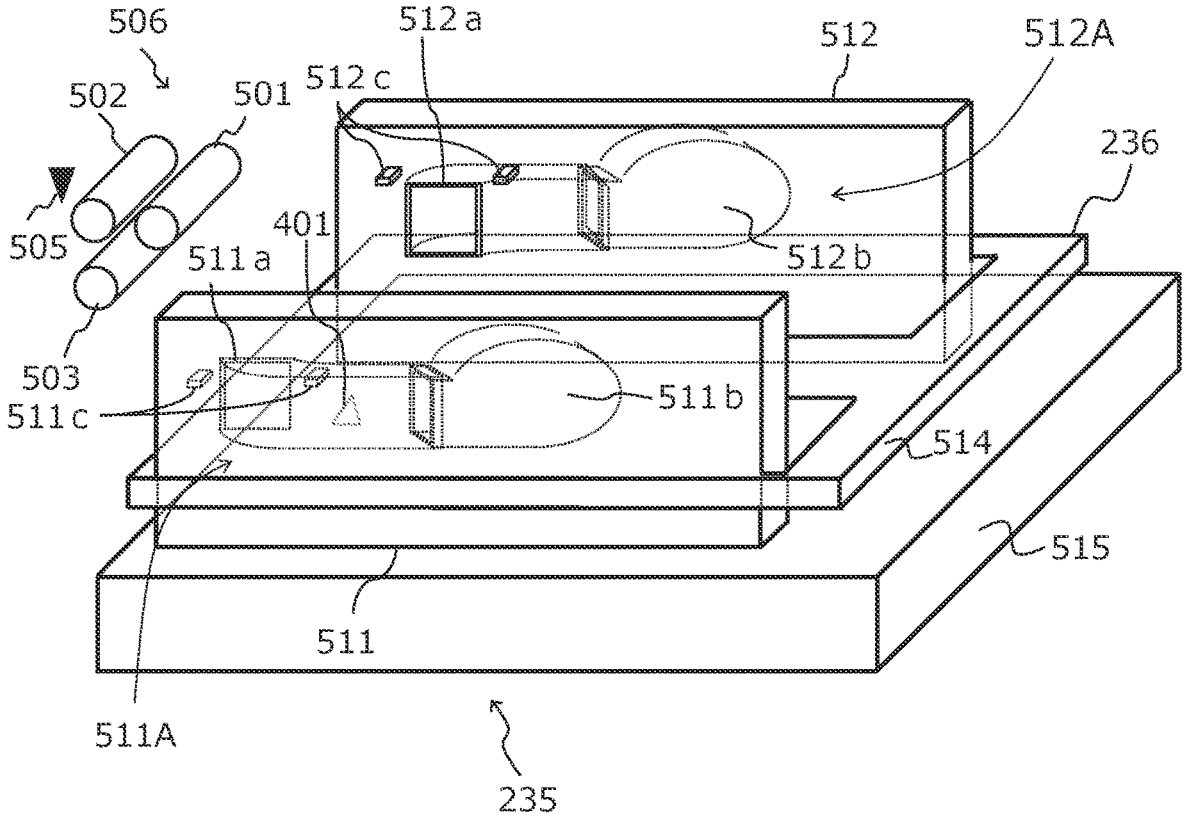
FIG. 3 is a schematic diagram illustrating a configuration of a manual sheet feed portion according to the first embodiment.

Next, the details of the manual sheet feed portion 235 serving as a sheet feeding apparatus will be described with reference to FIGS. 1 and 3. FIG. 3 is a schematic diagram illustrating a configuration of a manual sheet feed portion according to a first embodiment.

The manual sheet feed portion 235 includes, as illustrated in FIGS. 1 and 3, the sheet feed tray 236 serving as a supporting portion, and the sheet feeding portion 506 serving as a feeding portion for feeding sheets and separating sheets that have been subjected to multi-feed. Further, the sheet feeding portion 506 includes the pickup roller 501 serving as a feed roller that comes into contact with an uppermost sheet of the sheet bundle and that feeds the uppermost sheet. Further, the sheet feeding portion 506 includes the feed roller 502 and the retard roller 503 that serve as a separation portion for separating the sheets S fed from the pickup roller 501.

Further, in the manual sheet feed portion 235, the draw-out roller pair 504 that draws out the sheet S from the feed roller 502 and feeds the sheet to the image forming apparatus 201 is arranged downstream of the feed roller 502 in the sheet feeding direction. Further, a sheet feed sensor 505 serving as a sheet detection portion is arranged between the feed roller 502 and the draw-out roller pair 504 in the sheet feeding direction, that is, downstream of the sheet feeding portion 506 in the feeding direction. The sheet feed sensor 505 detects passing of the sheet S by outputting a signal corresponding to the presence/absence of the sheet S.

Further, as illustrated in FIG. 3, the sheet feed tray 236 is equipped with a manual feed tray table 515, and an elevation plate 514 serving as a supporting portion for supporting the sheet bundle formed of a plurality of sheets S. Further, a paper presence detection sensor 401 serving as a sheet detection portion for detecting that a sheet S has been supported on the sheet feed tray 236 is provided on the elevation plate 514. A position of the elevation plate 514 in a height direction is controlled according to a loaded amount of the sheet S by a lifting and lowering mechanism not shown.

Further, as illustrated in FIG. 3, side edge regulation plates 511 and 512 for regulating the position of the sheet S supported on the sheet feed tray 236 in a width direction orthogonal to a feeding direction are provided on the sheet feed tray 236. The side edge regulation plates 511 and 512 regulate the position of width-direction end portions of the sheet S, i.e., side edges of the sheet, set on the elevation plate 514. Air blowing portions 511A and 512A serving as separating portions are each disposed on the side edge regulation plates 511 and 512. The air blowing portion 511A includes a fan 511*b* driven by a fan motor 511M (refer to FIG. 2), and a duct 511*a* that guides the air sent from the fan 511*b* through an inner side of the side edge regulation plate 511 and blows the air toward the side of the sheet bundle. Similarly, the air blowing portion 512A includes a fan 512*b* driven by a fan motor 512M (refer to FIG. 2), and a duct 512*a* that guides the air sent from the fan 512*b* through the inner side of the side edge regulation plate 512 and blows the air toward the side of the sheet bundle. Further, the side edge regulation plates 511 and 512 are provided with flotation suppressing plates 511*c* and 512*c* in a vicinity of openings of the ducts 511*a* and 512*a* for preventing the sheets S to which air is blown from floating beyond the side edge regulation plates 511 and 512.

Detection of Opening and Closing of Sheet Feed Tray

Figure 5:
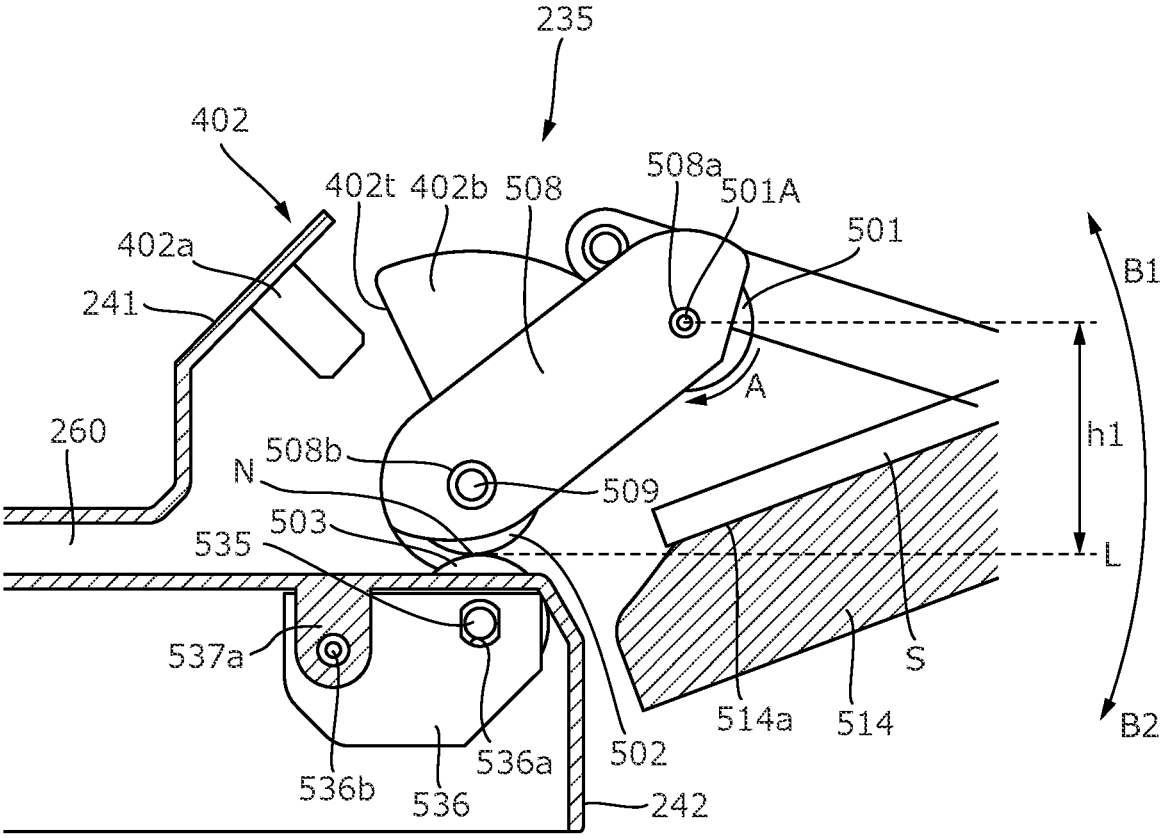
FIG. 5 is a cross-sectional side view illustrating a manual sheet feed portion in a state where a pickup roller is positioned at a separated position.
Figure 6:
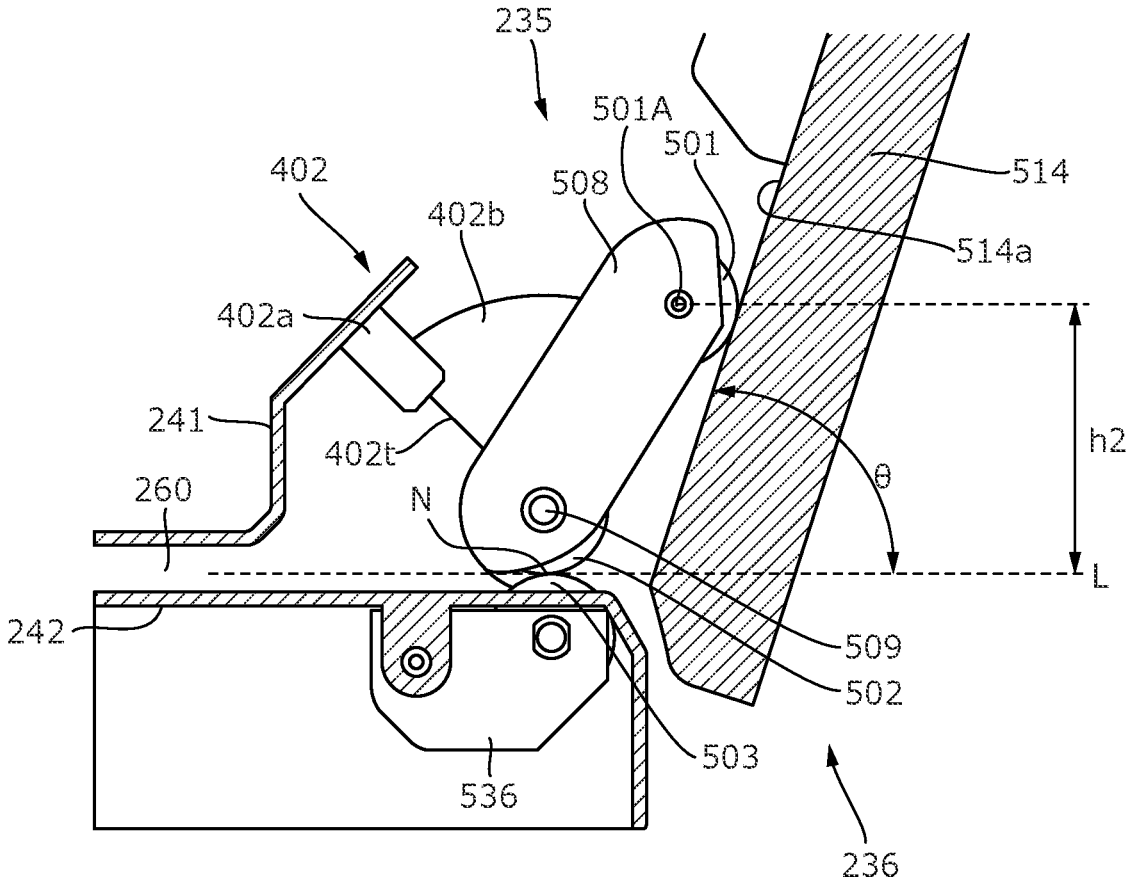
Figure 7:
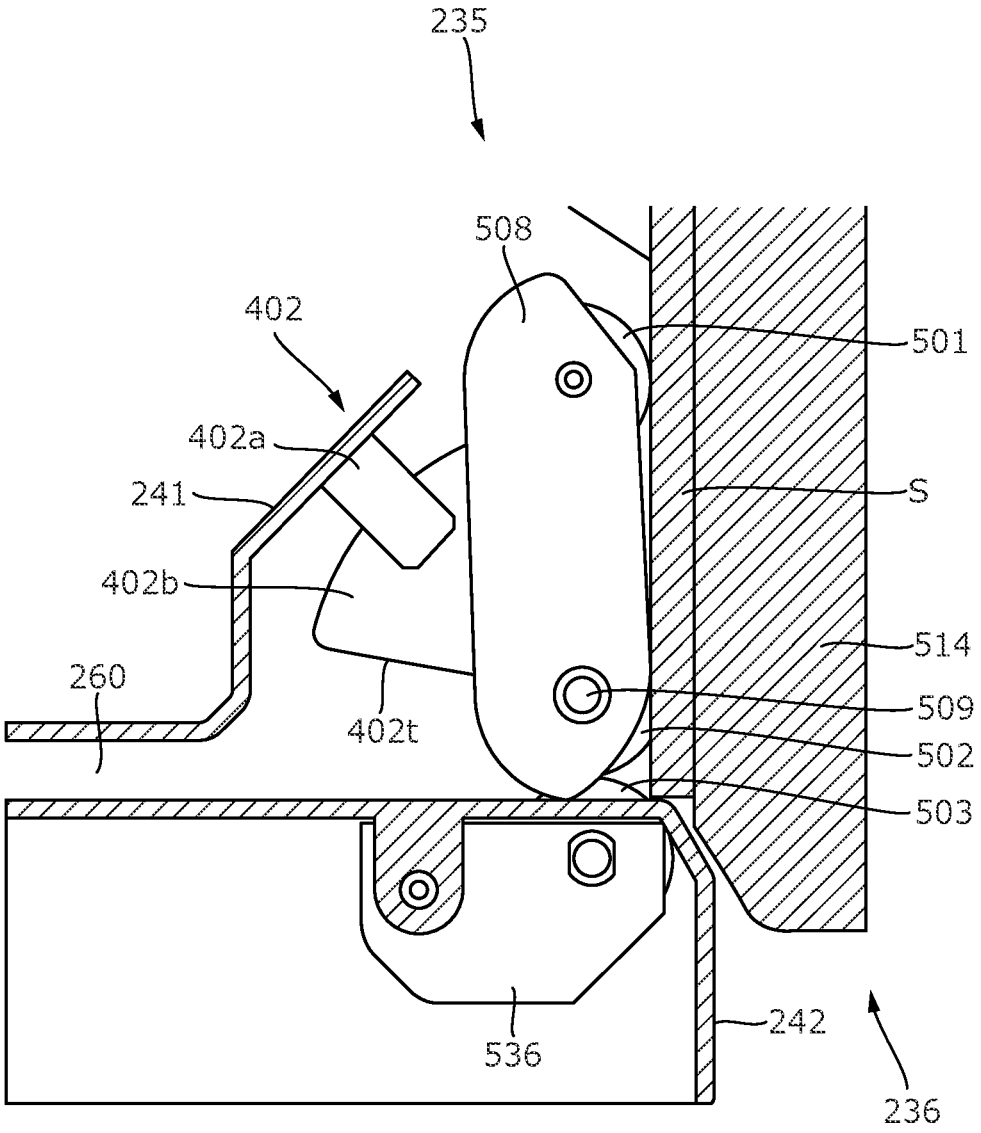
FIG. 7 is a cross-sectional side view illustrating the manual sheet feed portion in a state where a manual feed tray is closed.

Next, a configuration of a lifting plate detection sensor 402 for detecting the opening and closing of the sheet feed tray 236 in the manual sheet feed portion 235 and a detecting operation thereof will be described with reference to FIGS. 5, 6, and 7. FIG. 5 is a cross-sectional side view illustrating the manual sheet feed portion in a state where a pickup roller is positioned at a separated position. FIG. 6 is a cross-sectional side view illustrating the manual sheet feed portion in a state where the lifting plate detection sensor is turned ON. FIG. 7 is a cross-sectional side view illustrating the manual sheet feed portion in a state where the manual feed tray is closed.

At first, a configuration of a lifting plate for lifting and lowering the pickup roller 501 will be described with reference to FIG. 5. The apparatus body 201A of the image forming apparatus 201 supports the feed roller 502 rotatably about a feed roller shaft 509, and the feed roller shaft 509 supports a lifting plate 508 serving as a roller supporting portion relatively rotatably through a hole portion 508*b*. A hole portion 508*a* is formed on a leading edge portion of the lifting plate 508, and a pickup roller shaft 501A is rotatably supported on the hole portion 508*a*. The above-mentioned pickup roller 501 is rotatably supported on the pickup roller shaft 501A. The feed roller shaft 509 is connected to a feeding motor 520 (refer to FIG. 2) through a drive transmission mechanism not shown, and a synchronization mechanism not shown that connects and synchronizes the feed roller shaft 509 and the pickup roller shaft 501A is disposed on an inner side of the lifting plate 508. That is, the feed roller 502 and the pickup roller 501 are rotated in synchronization by the driving force of the feeding motor 520.

Figure 2:
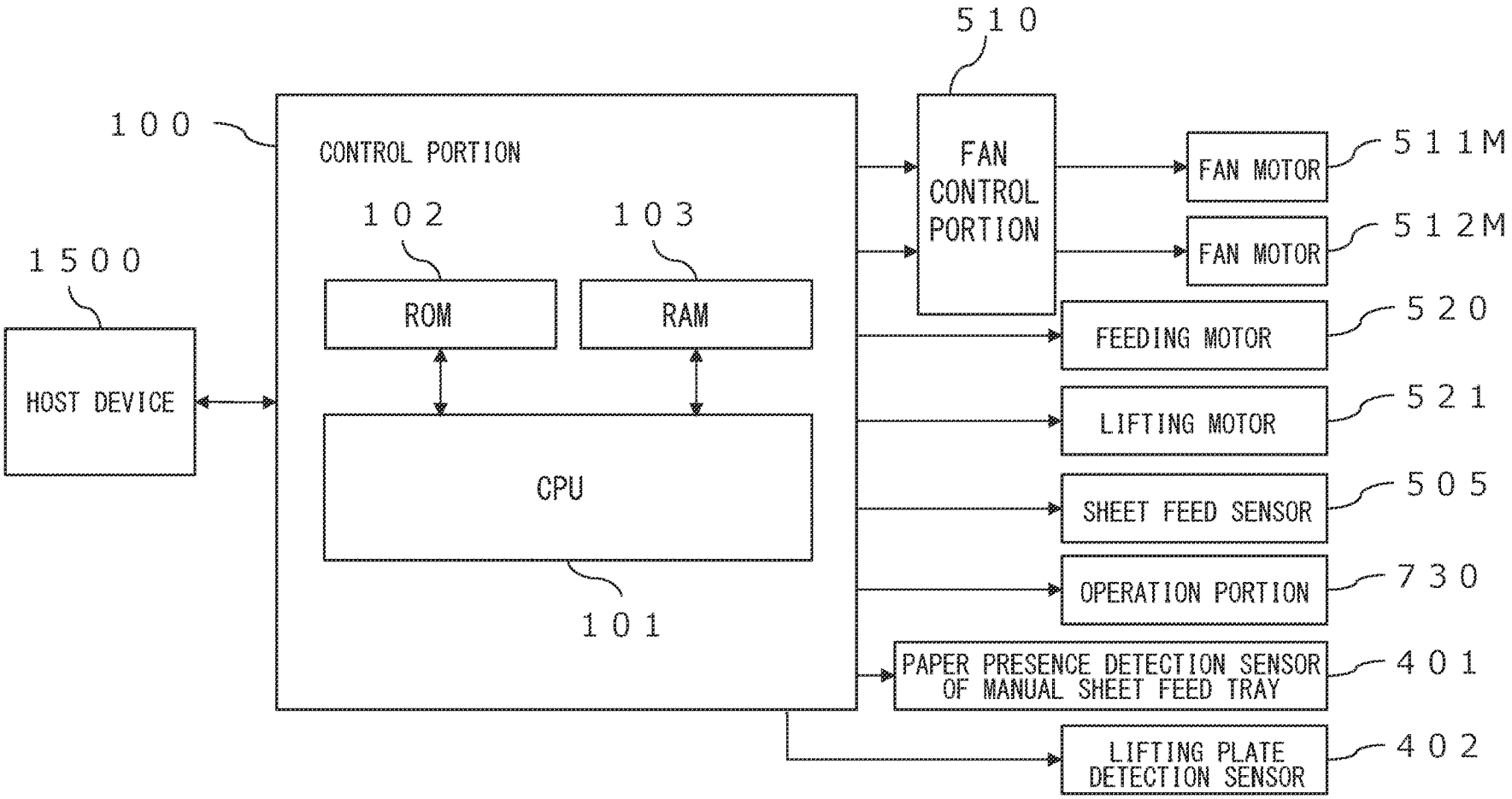
FIG. 2 is a block diagram illustrating a control system of an image forming system according to the first embodiment.

The lifting plate 508 is supported in a liftable and lowerable manner about the feed roller shaft 509 by the lifting and lowering mechanism not shown driven by a lifting motor 521 (refer to FIG. 2). Then, the pickup roller 501 supported by a leading edge portion of the lifting plate 508 is movable among a contact position, a separated position, and a stored position by the lifting and lowering of the lifting plate 508. The pickup roller 501 comes into contact with the sheet S supported on the elevation plate 514 of the opened sheet feed tray 236 in a state positioned at the contact position, and feeds the sheet S. Further, the pickup roller 501 is retained at the separated position separated from the sheet S supported on the sheet feed tray 236 in the opened state where the sheet feed tray 236 is opened by the user. Then, when the sheet feed tray 236 is closed by the user, the pickup roller 501 that has been positioned at the separated position will be positioned at the stored position where it is stored within the apparatus body 201A, as illustrated in FIG. 7.

Further, as illustrated in FIG. 5, a holder retaining portion 537*a* that rotatably supports a rotation shaft 536*b* of a retard roller holder 536 is formed on a multi-frame 242 arranged on the apparatus body 201A. A hole portion 536*a* is formed on the retard roller holder 536, and a retard roller shaft 535 is rotatably supported on the hole portion 536*a*. The retard roller 503 is rotatably supported on the retard roller shaft 535. The retard roller 503 is urged by a spring not shown arranged between the multi-frame 242 and the retard roller holder 536 against the feed roller 502. A torque limiter not shown is attached to the retard roller shaft 535, and when two or more sheets S are fed by the pickup roller 501, the torque limiter is idly rotated and the retard roller 503 stops. Thereby, the sheet S is separated sheet by sheet at a separation nip N, i.e., nip, formed by the feed roller 502 and the retard roller 503.

Detection of Movement of Sheet Feed Tray

An upper frame 241 that forms a conveyance path 260 together with the multi-frame 242 is disposed above the multi-frame 242. The lifting plate detection sensor 402 composed of an on-off sensor, such as a photosensor, is disposed on the upper frame 241. The lifting plate detection sensor 402 is configured as an opening and closing movement detection portion that detects movement of the sheet feed tray 236 in the opening and closing direction according to the first embodiment. In other words, according to the present embodiment, the lifting plate detection sensor 402 described above may be defined as an opening and closing detection portion that detects the sheet feeding position and the closed position of the sheet feed tray 236 serving as an opening and closing portion.

Further according to the first embodiment, the lifting plate detection sensor 402 is also configured as an opening and closing detection sensor that detects whether the sheet feed tray 236 is in the closed position closed with respect to the apparatus body 201A or an opened position opened with respect thereto.

Specifically, the lifting plate detection sensor 402 includes a sensor portion 402*a* serving as a first signal output portion, and a flag portion 402*b*, and the sensor portion 402*a* is fixed to the upper frame 241 being fixed to the apparatus body 201A. Further, the flag portion 402*b* is fixed to the position opposed to the sensor portion 402*a* on the upper surface of the lifting plate 508. The flag portion 402*b* is formed approximately in an arc shape, having a leading edge surface 402*t* along a radial direction about the feed roller shaft 509, and the leading edge surface 402*t* serves as an area that is initially detected by the sensor portion 402*a*. It may also be possible to have the sensor portion 402*a* fixed to the lifting plate 508 and the flag portion 402*b* fixed to the upper frame 241. That is, the sensor portion 402*a* may be fixed to either one of the upper frame 241, that is, the apparatus body 201A, and the lifting plate 508, and the flag portion 402*b* may be fixed to the other one of the upper frame 241 and the lifting plate 508.

A lifting plate detection sensor 402 is turned ON by having light shielded by the flag portion 402*b*, and turned OFF by having light transmitted without being shielded by the flag portion 402*b*, such that the output signal sent to a control portion 100 described later is varied. The ON and OFF of the output signal may be the opposite. The lifting plate detection sensor 14 configured as above detects a predetermined opening angle θ (refer to FIG. 6) described later of the sheet feed tray 236 by being turned ON from the OFF state, and in other words, detects that the sheet feed tray 236 has moved in the opening and closing direction. Further, the lifting plate detection sensor 14 detects an opened position where the sheet feed tray 236 is opened and a closed position where the sheet feed tray 236 is closed, with the predetermined opening angle θ of the sheet feed tray 236 serving as a boundary.

In a state where the pickup roller 501 is positioned at the separated position, as illustrated in FIG. 5, the lifting plate detection sensor 402 is not shielded by the flag portion 402*b*. In this state, the sheet feed tray 236 is opened to a maximum opening. Then, when the sheet feed tray 236 is closed from this state, the pickup roller 501 is pressed by the sheet feed tray 236 or the sheet S supported on or the sheet feed tray 236 from the separated position toward the stored position. Thereby, the pickup roller 501, the lifting plate 508, and the flag portion 402*b* pivot about the feed roller shaft 509 toward the apparatus body 201A.

As illustrated in FIG. 6, in a state where the leading edge surface 402*t* of the flag portion 402*b* is detected by the lifting plate detection sensor 402, the opening angle of the sheet feed tray 236 is at angle θ. In the present embodiment, the opening angle is an angle formed by a nip line L, which is a tangent at the separation nip N, and a sheet supporting surface 514*a* of the elevation plate 514 of the sheet feed tray 236. In this state, a height h2 from the nip line L to the pickup roller shaft 501A is higher than a height h1 in a state where the pickup roller 501 is positioned at a standby position illustrated in FIG. 5.

If the sheet S supported on the sheet feed tray 236 is fed by the pickup roller 501 at the height h2 that is significantly higher than the height h1 at the standby position, the angle at which the sheet S enters the separation nip N becomes steep, and normal feeding may not be performed. Therefore, in a case where the opening angle of the sheet feed tray 236 is greater than angle θ, that is, equal to a predetermined angle or greater, the lifting plate detection sensor 402 is turned ON by detecting the flag portion 402*b*. Further, as illustrated in FIG. 7, even when the pickup roller 501 is positioned at the stored position, the lifting plate detection sensor 402 is in an ON state by detecting the flag portion 402*b*. As described above, the lifting plate detection sensor 402 can detect that the sheet feed tray 236 has moved from the opened position toward the closed position to a closing direction B1 greater than the predetermined angle θ in the opening and closing direction illustrated by arrow B1-B2. Further, the lifting plate detection sensor 402 detects that the sheet feed tray 236 is in the opened position and in the opened state if it is opened further than the predetermined angle θ, and detects that the sheet feed tray 236 is in the closed position and in the closed state if it is closed further than the predetermined angle θ.

Configuration of Control System of Image Forming System

Next, a configuration of a control system in the image forming system 600 will be described with reference to FIG. 2. FIG. 2 is a block diagram illustrating the control system of the image forming system according to the first embodiment.

The control portion 100 according to the present embodiment is disposed in the image forming apparatus 201, for example, and includes a CPU 101, a ROM 102, and a RAM 103. The control portion 100 is a control unit that controls the image forming apparatus 201, the sheet feed deck 800, and the manual sheet feed portion 235 in an integrated manner. The control portion 100 is connected to the host device 1500 and the operation portion 730, communicates information therewith, and performs signal processing and sequence control for various processing devices. Further, the host device 1500 is an external apparatus such as a personal computer, an image scanner, and a facsimile. Further, the control portion 100 is connected to the feeding motor 520 serving as a motor for driving a fan control portion 510, and the pickup roller 501, and also to the sheet feed sensor 505. Further, the control portion 100 is also connected to the paper presence detection sensor 401 and the lifting plate detection sensor 402.

Air Blowing Operation

Figure 4:
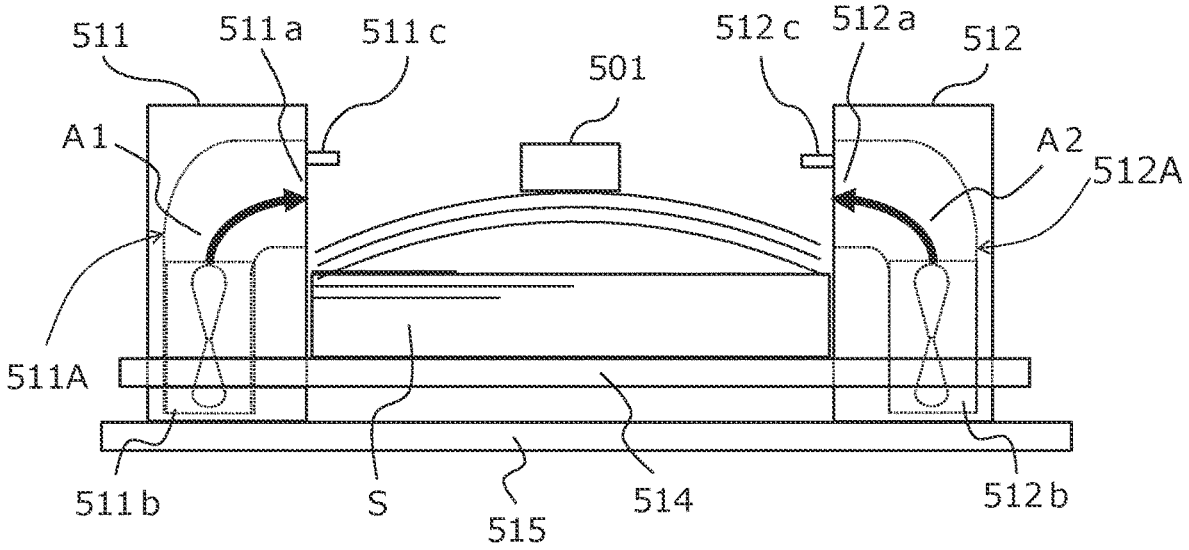
FIG. 4 is a schematic diagram illustrating a state in which an air blowing operation is performed by the manual sheet feed portion according to the first embodiment.

Next, an operation for blowing air from the air blowing portions 511A and 512A to sides of the sheet bundle will be described with reference to FIG. 4. FIG. 4 is a schematic diagram illustrating a state where an air blowing operation is performed by the manual sheet feed portion 235 according to the first embodiment.

As illustrated in FIG. 4, when the control portion 100 starts the air blowing operation, air is blown from the fans 511*b* and 512*b* of the air blowing portions 511A and 512A toward the side surfaces of the sheet bundle, as illustrated in arrows A1 and A2. Then, a few to tens of sheets S on the upper part of the sheet bundle are separated and floated, and the uppermost sheet S comes into contact with the flotation suppressing plates 511*c* and 512*c*, by which the floating of the separated sheets S is suppressed. Thereby, the adhesion between the sheets S is reduced, and for example, even in a case where the sheets S have a smooth surface, such as in the case of coated paper, the sheets may be fed by the conveyance force of the pickup roller 501.

Problem when Sheet Feed Tray 236 is Moved in Opening and Closing Direction

Figure 8:
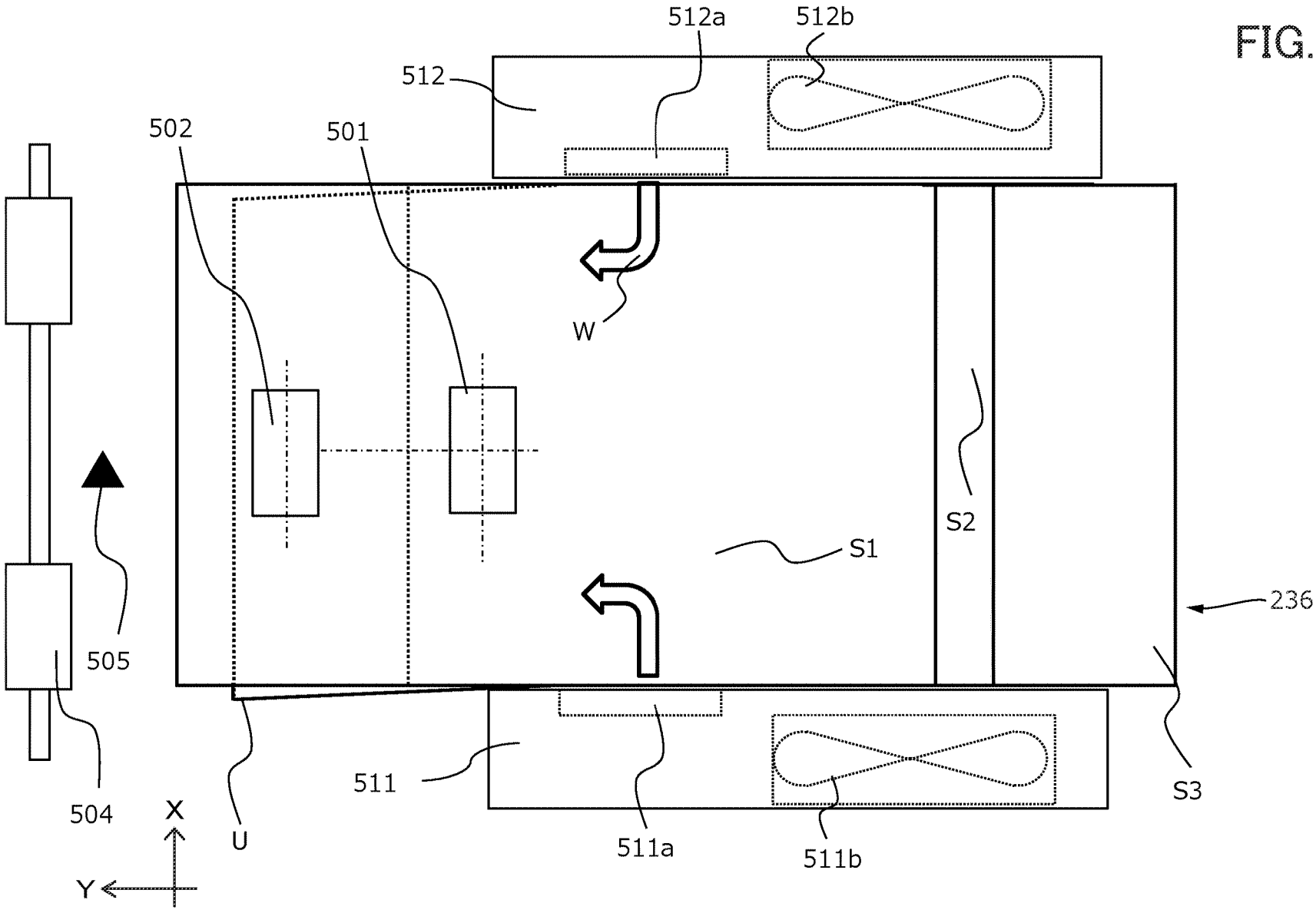
FIG. 8 is a schematic diagram illustrating a position of a sheet in a case where the sheet feed tray according to the first embodiment is lifted.

The problem that occurs in a case where the sheet feed tray 236 is moved from the opened position to be closed, for example by the user, after the air blowing operation has been started will be described. FIG. 8 is a schematic diagram illustrating a position of a sheet in a case where the sheet feed tray according to the first embodiment has been lifted.

For example, the user may start feeding of sheets, i.e., start a job, in a state where the sheets S are set on the sheet feed tray 236 in the opened position (refer to FIG. 5). However, after the feeding is started, the sheet feed tray 236 may be moved and closed beyond the predetermined angle θ in the opening and closing direction, for example, by the user touching or lifting the sheet feed tray 236 (refer to FIG. 6). In this case, as illustrated in FIG. 8, the air blowing from the air blowing portions 511A and 512A may be blown toward the inclining direction of the sheet feed tray 236, as illustrated by the arrow W. Then, the balance of air blowing toward the sheet S1 and the sheet S2 positioned on the upper portion of the set position of a normal sheet feed tray 236 is varied. Therefore, sheet S2, which is the second sheet, is normally positioned at the position of sheet S3 with respect to the uppermost sheet S1, but the leading edge of the second sheet is conveyed together with sheet S1 to position U. As a result, the sheet S2 moves greatly beyond the position of the side edge regulation plates 511 and 512, such that the non-regulated portion of the sheet S2 by the side edge regulation plates 511 and 512 may be inclined on the elevation plate 514 and fed in such a skewed position. Therefore, according to the present embodiment, the air blow stop determination processing is performed in the sheet feed control as described below.

Figure 9:
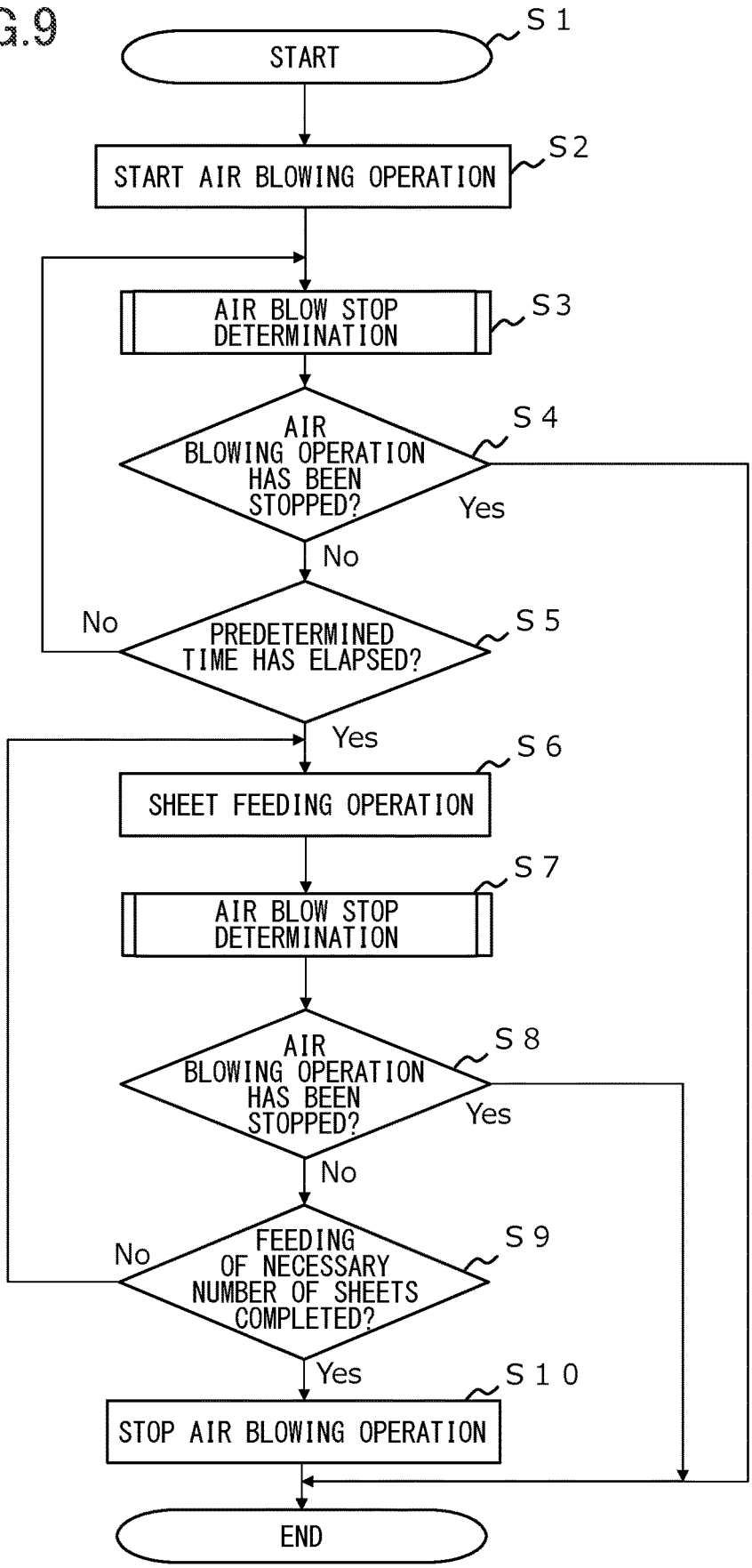
FIG. 9 is a flowchart illustrating a sheet feed control in a separating mode according to the first embodiment.
Figure 10:
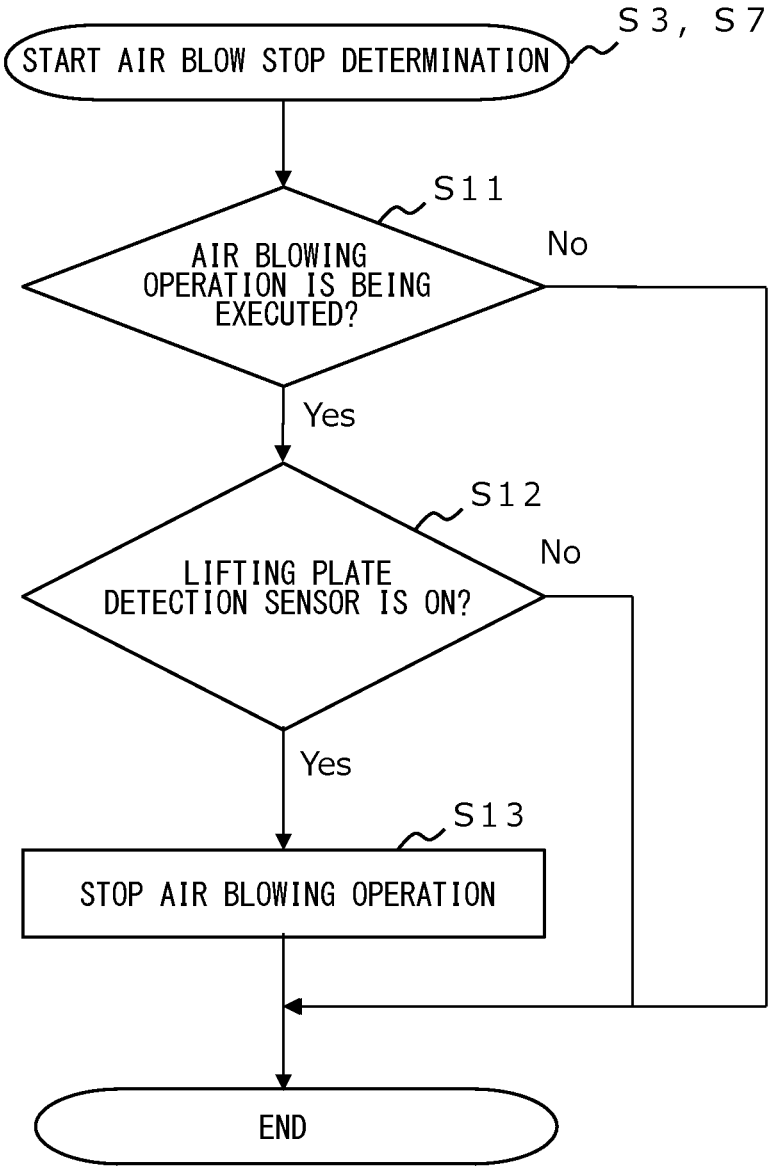
FIG. 10 is a flowchart illustrating an air blow stop determination processing according to the first embodiment.

Sheet Feed Control and Air Blow Stop Determination Processing According to First Embodiment Next, a sheet feed control according to the first embodiment and an air blow stop determination processing executed during the sheet feed control will be described with reference to FIGS. 9 and 10. FIG. 9 is a flowchart illustrating a sheet feed control in a separating mode according to the first embodiment. FIG. 10 is a flowchart illustrating the air blow stop determination processing according to the first embodiment.

The sheet feed control illustrated in FIG. 9 is a process of feeding sheets by a separating mode in which the air blowing operation is performed to the sheets S set on the sheet feed tray 236. According to the present image forming apparatus 201, sheets may be fed by a normal mode in which the sheets are fed without performing air blow toward the sheets S set on the sheet feed tray 236. However, the normal mode is a mode where the air blowing operation is simply not performed, such that the description of the normal mode is omitted, and the separating mode will be described below. The normal mode is suitable for feeding sheets, such as normal paper and thin paper, having a normal, i.e., standard, or rough surface property, and a thickness that is normal or thinner. The separating mode is suitable for feeding sheets, such as coated paper, having a fine and smooth surface property compared to a normal, or standard, surface property and a thickness that is thicker than normal paper.

In a state where starting of a job, for example, of printing a predetermined number of sheets, such as 15 sheets, of coated paper is output from the operation portion 730 or an external computer (not shown), the control portion 100 starts a sheet feed control executed as the separating mode as illustrated in FIG. 9 (S1). Then, at first, the control portion 100 drives the fan motors 511M and 512M of the air blowing portions 511A and 512A (refer to FIG. 2) and starts an air blowing operation of blowing air to the side surfaces of the sheet bundle (S2). Thereby, the few to few tens of sheets S positioned on the upper part of the sheet bundle is separated and floated, and the floating of the sheets S is suppressed by the flotation suppressing plates 511*c* and 512*c* (refer to FIG. 4), such that the adhesion between the separated sheets is reduced.

Next, the control portion 100 performs an air blow stop determination processing, that is, determines whether to stop the air blowing operation (S3). That is, as described in detail later, for example, whether the sheet feed tray 236 has been lifted up by the user and moved in the opening and closing direction, that is, whether the sheet feed tray has been moved from the sheet feeding position to the closed position, is determined, and if the sheet feed tray 236 has been moved, the air blowing operation is stopped. Here, the processing is described assuming that the air blowing operation has not been stopped.

In step S4, whether the air blowing operation has been stopped in the air blow stop determination processing is determined, and if the air blowing operation has not been stopped (S4: No), the procedure stands by until a predetermined time, such as approximately 10 seconds, has elapsed (S5: No). That is, the predetermined time is set by considering the time from when the fan motors 511M and 512M start to rotate from the rotation sopped state and when they reach a desired number of rotations, i.e., rotation speed, and the time required for the floating of the sheets S to stabilize. Further, during that period of time, the air blow stop determination processing (S3) is also performed repeatedly. After the elapse of the predetermined timed (S5: Yes), the feeding operation of the sheets S is started (S6). The starting of the feeding operation refers to the sheet S being fed by the pickup roller 501 (refer to FIG. 3) rotated by the drive of the feeding motor 520 in a state in contact with the uppermost sheet S. Thereafter, if multiple sheets S are sent in a superposed manner, the sheets are separated at the separation portion composed of the feed roller 502 and the retard roller 503, and when an uppermost sheet S is detected as having passed through the sheet feed sensor 505, the feeding operation of one sheet is completed.

When the sheet feeding operation is started (S6), the air blow stop determination processing is performed again (S7), and if the air blowing operation has not been stopped (S8: No), it is determined whether the feeding of necessary number of sheets, such as 15 sheets, has been completed (S9). For example, if the feeding of 15 sheets has not been completed (S9: No), the sheet feeding operation is continued, and during that time, the air blow stop determination processing (S7) is also performed repeatedly. Then, when the feeding of necessary number of sheets S, such as 15 sheets, has been completed (S9: Yes), the control portion 100 stops the air blowing operation (S10), and the sheet feed control is ended.

Next, the details of the above-mentioned air blow stop determination processing (S3, S7) will be described. As illustrated in FIG. 10, at first, the control portion 100 determines whether the air blowing operation is being executed (S11), and if the air blowing operation is not being executed (S11: No), the air blow stop determination processing is ended. Further, if the air blowing operation is being executed (S11: Yes), whether the output signal of the above-mentioned lifting plate detection sensor 402 is ON is determined (S12). If the lifting plate detection sensor 402 is not ON, but OFF (S12: No), it is determined that the sheet feed tray 236 is at the opened position and not moved, and the air blow stop determination processing is ended.

Meanwhile, if the output signal of the lifting plate detection sensor 402 is ON (S12: Yes), it means that a state is detected where the sheet feed tray 236 is lifted up, for example by a user, and in a closed position closed beyond the predetermined angle θ. In other words, a state is detected where the sheet feed tray 236 is lifted up, for example by a user, and moved. Therefore, as described above, the sheet S may be inclined and sheet jamming may be caused, such that the control portion 100 stops the above-mentioned fan motors 511M and 512M (refer to FIG. 2) to stop the air blowing operation to the sheets S (S13), and the air blow stop determination processing is ended.

Therefore, in the sheet feed control according to the first embodiment, before the elapse of a predetermined time from the start of the air blowing operation (S5: No), if the sheet feed tray 236 is moved to the closed position (S3, S12: Yes), the air blowing operation is stopped (S13). Then, if it is determined that the air blowing operation has been stopped (S4: Yes), it is determined that the sheet feed tray 236 has been closed to the closed position, such that the present sheet feed control is ended without performing the feeding operation (S6). Therefore, if the user lifts up the sheet feed tray 236 and moves the tray to the closed position during a predetermined time after the job has been started and while preparation for starting feeding of the sheet S is performed, the air blowing operation is stopped before starting feeding of the sheet S, and the feeding operation may also be stopped. Thereby, it becomes possible to prevent the position of the sheet S from being misaligned by air blown thereto and causing skewing of the sheet S, and to reduce the generation of sheet jamming.

In the sheet feed control according to the first embodiment, after starting the feeding operation of the sheet S (S6), if the sheet feed tray 236 is moved to the closed position (S7, S12: Yes), the air blowing operation is stopped (S13). Then, when it is determined that the air blowing operation has been stopped (S8: Yes), it is determined that the sheet feed tray 236 has been closed to the closed position, such that the present sheet feed control is ended at that point of time without performing the feeding operation (S6). Therefore, if the user lifts up the sheet feed tray 236 and moves the tray to the closed position in a state where the feeding of sheets has been started and the feeding of the sheets S is performed, the air blowing operation is stopped even during feeding of the sheets S, and the feeding operation may also be stopped. Thereby, it becomes possible to reduce the skewing of the sheets S by the position of the sheets S being misaligned by the air blowing operation, which may lead to jamming of sheets.

Summary of First Embodiment

As escribed above, according to the sheet feed control of the first embodiment, a separating mode is executed in which the feeding of sheets is performed while performing the air blowing operation. In a case where the sheet feed tray 236 is moved to the closed position during execution of the separating mode, the air blowing operation may be stopped, such that the occurrence of jamming of sheets may be reduced. Further, it becomes possible to prevent the continuation of the air blowing operation even after the sheet feed tray 236 has been closed and the feeding operation has been stopped, such that unnecessary power consumption may be cut down.

Further according to the image forming apparatus 201 of the first embodiment, the movement of the sheet feed tray 236 in the opening and closing direction is detected by the lifting plate detection sensor 402, which is an on-off sensor, such that the movement of the sheet feed tray 236 may be detected by a simple configuration. Further, the lifting plate detection sensor 402 also serves as a sensor for detecting the opening and closing of the sheet feed tray 236, such that the movement of the sheet feed tray 236 in the opening and closing direction and the opened or closed state of the sheet feed tray 236 may be detected without disposing a different sensor.

Second Embodiment

Figure 11:
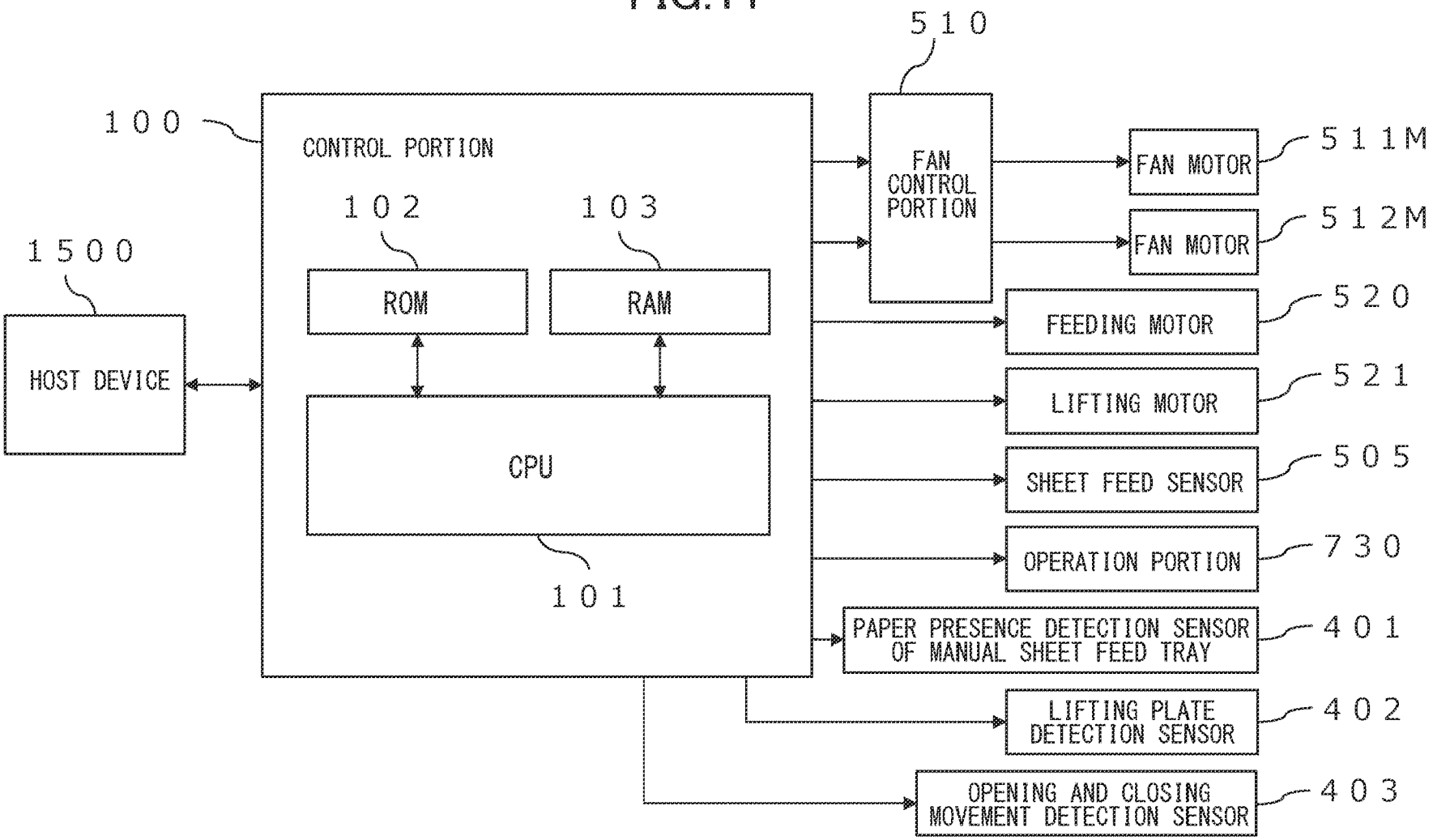
FIG. 11 is a block diagram illustrating a control system of an image forming system according to a second embodiment.
Figure 12A:
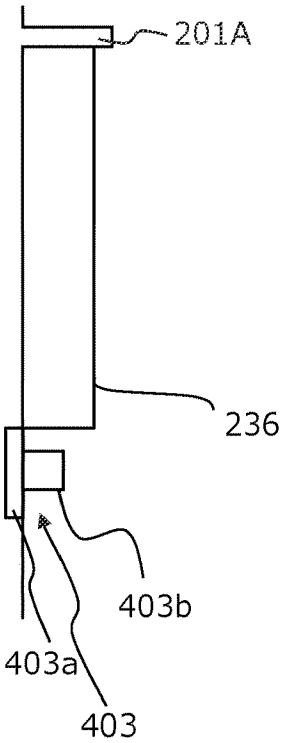
FIG. 12A is a schematic side view illustrating a sheet feed tray in a closed state and an opening and closing movement detection sensor.
Figure 12B:
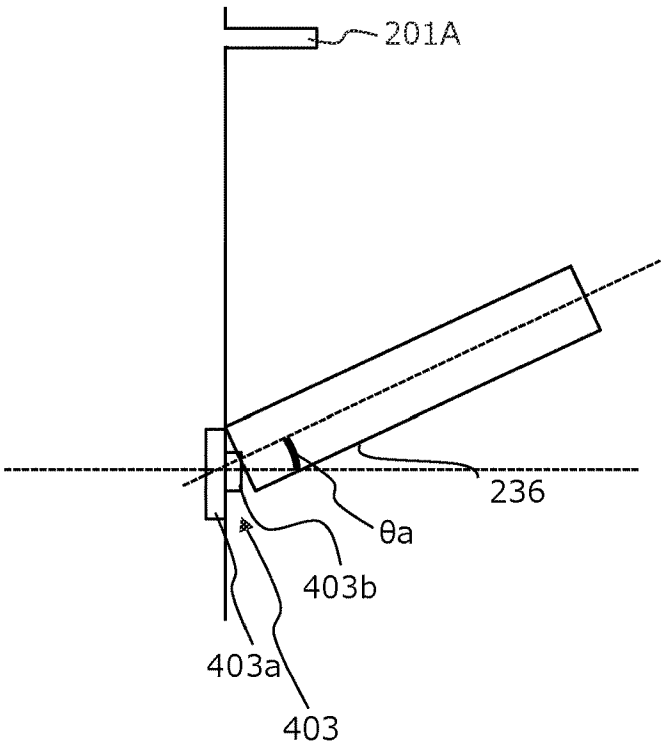
FIG. 12B is a schematic side view illustrating the sheet feed tray in an opened state and the opening and closing movement detection sensor.
Figure 12C:
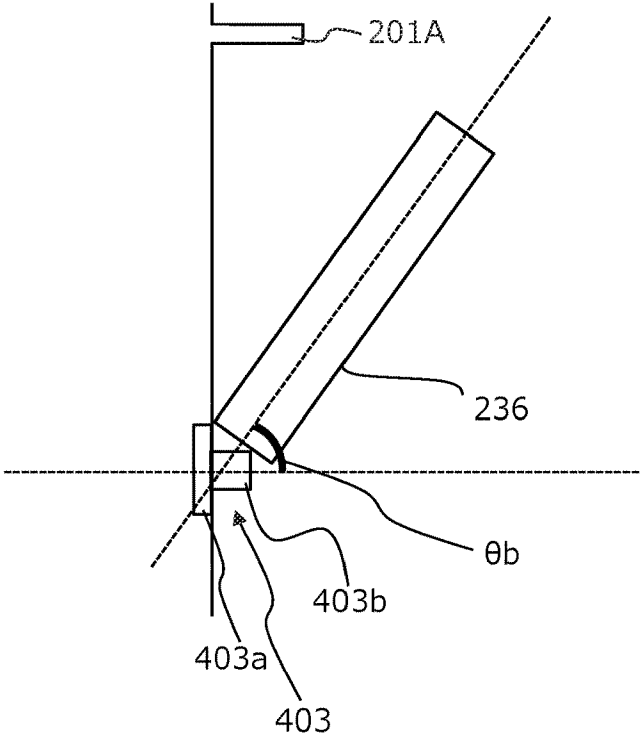
FIG. 12C is a schematic side view illustrating the sheet feed tray in a lifted state and the opening and closing movement detection sensor.
Figure 13:
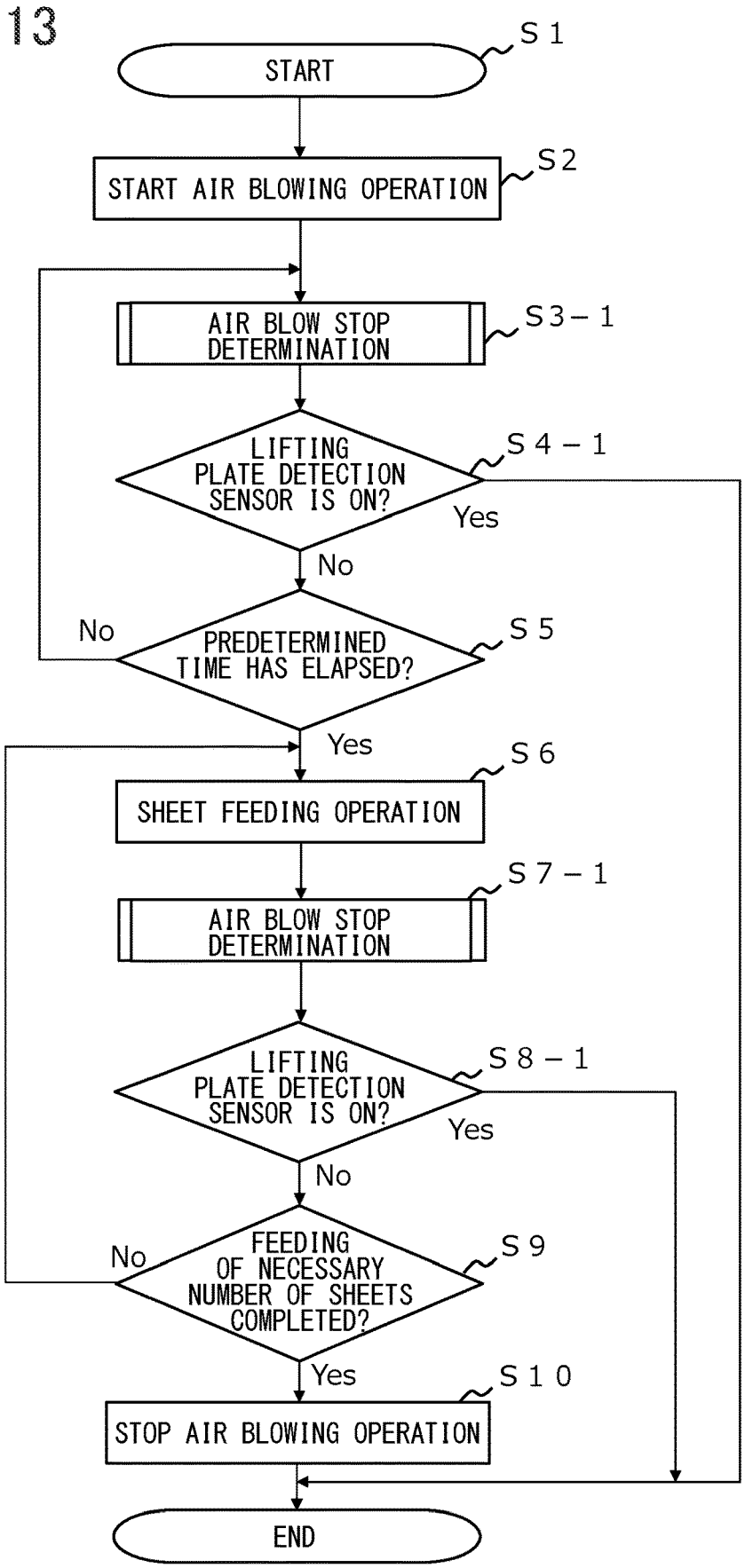
FIG. 13 is a flowchart illustrating a sheet feed control in a separating mode according to the second embodiment.
Figure 14:
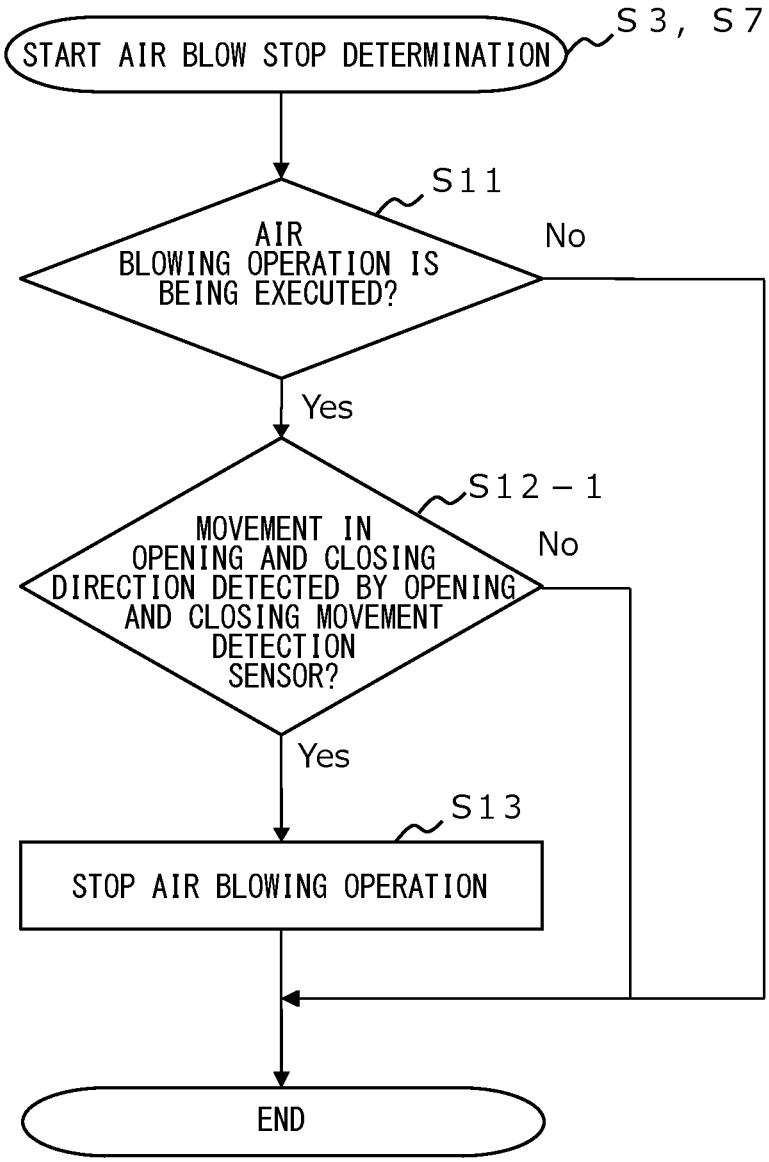
FIG. 14 is a flowchart illustrating an air blow stop determination processing according to the second embodiment.

Next, a second embodiment having a part of the first embodiment modified will be described with reference to FIGS. 11, 12A to 12C, 13, and 14. FIG. 11 is a block diagram illustrating a control system of an image forming system according to a second embodiment. FIG. 12A is a schematic side view illustrating a sheet feed tray in a closed state and an opening and closing movement detection sensor. FIG. 12B is a schematic side view illustrating the sheet feed tray in an opened state and the opening and closing movement detection sensor. FIG. 12C is a schematic side view illustrating the sheet feed tray in a lifted state and the opening and closing movement detection sensor. FIG. 13 is a flowchart illustrating a sheet feed control in a separating mode according to the second embodiment. FIG. 14 is a flowchart illustrating an air blow stop determination processing according to the second embodiment.

The image forming apparatus 201 according to the second embodiment includes an opening and closing movement detection sensor 403 serving as the opening and closing movement detection portion or a position change detection sensor, compared to the first embodiment. That is, the image forming apparatus 201 detects the opening and closing of the sheet feed tray 236 by the above-described lifting plate detection sensor 402 and detects the movement of the sheet feed tray 236 in the opening and closing direction by the opening and closing movement detection sensor 403.

Opening and Closing Movement Detection Sensor

Specifically, as illustrated in FIG. 11, the control portion 100 has the opening and closing movement detection sensor 403 connected thereto. As illustrated in FIGS. 12A, 12B, and 12C, the opening and closing movement detection sensor 403 is a so-called push sensor, and is composed of a sensor portion 403*a* serving as a second signal output portion and a push portion 403*b* serving as a moving portion. The push portion 403*b* is disposed to protrude from the sensor portion 403*a* in an expandable and contractable manner by being urged by an urging member not shown, and it is abutted against the sheet feed tray 236 and moved in sliding motion when the sheet feed tray 236 is opened. The sensor portion 403*a* outputs a signal corresponding to the position, or position change, of the push portion 403*b* to the control portion 100, that is, outputs a signal corresponding to a moving amount of the sheet feed tray 236 in the opening and closing direction to the control portion 100.

Detection of Movement of Sheet Feed Tray

As illustrated in FIG. 12B, an angle of the sheet feed tray 236 with respect to a horizontal direction is angle θa in a state where the sheet feed tray 236 is fully opened, and as illustrated in FIG. 12C, the angle of the sheet feed tray 236 with respect to the horizontal direction is angle θb in a state where the sheet feed tray 236 is lifted up. As described, while the sheet feed tray 236 is moved from angle θa to angle θb, the push portion 403*b* is moved in sliding motion and the position thereof is changed according to the angle of the sheet feed tray 236, and according to the position change, the sensor portion 403*a* outputs a signal to the control portion 100. Thereby, the control portion 100 may determine whether the sheet feed tray 236 is opened or lifted up based on the signal from the opening and closing movement detection sensor 403.

Further, the angle θb is a smaller angle than the angle of the sheet feed tray 236 when the lifting plate detection sensor 402 detects the flag portion 402*b* according to the first embodiment (refer to FIG. 6). That is, the opening and closing movement detection sensor 403 is a sensor that detects that the sheet feed tray 236 is moved in the opening and closing direction from a state where the sheet feed tray 236 is in an opened position. In other words, the lifting plate detection sensor 402 detects that the sheet feed tray 236 is in the closed position in a state where the sheet feed tray 236 is closed until the sheet feed tray 236 is at an angle greater than the angle θb and the opening and closing movement detection sensor 403 may no longer detect the moving amount of the sheet feed tray 236.

In the present embodiment, a so-called push sensor including the push portion 403*b* is used to detect the movement, that is, inclination, of the sheet feed tray 236 in the opening and closing direction, but any configuration may be adopted as long as the inclination of the sheet feed tray 236 may be detected.

Sheet Feed Control and Air Blow Stop Determination Processing According to Second Embodiment Next, a sheet feed control according to the second embodiment and an air blow stop determination processing executed during the sheet feed control will be described with reference to FIGS. 13 and 14. In the description of the sheet feed control and the air blow stop determination processing according to the second embodiment, steps that differ from those of the first embodiment will be described with a suffix "-1" attached thereto. The other steps are similar to the steps of the first embodiment.

In a state where starting of a job, for example, of printing a predetermined number of sheets, such as 15 sheets, of coated paper is output from the operation portion 730 or an external computer (not shown), the control portion 100 starts a sheet feed control executed as the separating mode as illustrated in FIG. 13 (S1). Then, at first, the control portion 100 starts an air blowing operation of blowing air to the side surfaces of the sheet bundle (S2). Thereby, the few to few tens of sheets S positioned on the upper part of the sheet bundle is separated, and the adhesion between the separated sheets is reduced.

Next, the control portion 100 performs an air blow stop determination processing, that is, determines whether to stop the air blowing operation (S3-1). That is, as described in detail later, for example, whether the sheet feed tray 236 has been lifted up by the user and moved in the opening and closing direction is determined, and if the sheet feed tray 236 has been moved, the air blowing operation is stopped. Here, the processing is described assuming that the air blowing operation has not been stopped.

In step S4-1, whether the lifting plate detection sensor 402 is ON is determined, and if the lifting plate detection sensor 402 is not ON (S4-1: No), the procedure stands by until a predetermined time, such as approximately 10 seconds, has elapsed (S5: No). During that time, the air blow stop determination processing (S3-1) is also performed repeatedly. After the predetermined time has elapsed (S5: Yes), the feeding operation of the sheets S is started (S6).

When the sheet feeding operation is started (S6), the air blow stop determination processing is performed again (S7-1), and if the lifting plate detection sensor 402 is not ON (S8-1: No), it is determined whether the feeding of necessary number of sheets S, such as 15 sheets, has been completed (S9). For example, if the feeding of 15 sheets has not been completed (S9: No), the sheet feeding operation is continued, and during that time, the air blow stop determination processing (S7-1) is also performed repeatedly. Then, when the feeding of necessary number of sheets, such as 15 sheets, has been completed (S9: Yes), the control portion 100 stops the air blowing operation (S10), and the sheet feed control is ended.

Next, the details of the above-mentioned air blow stop determination processing (S3-1, S7-1) will be described. As illustrated in FIG. 14, at first, the control portion 100 determines whether the air blowing operation is being executed (S11), and if the air blowing operation is not being executed (S11: No), the air blow stop determination processing is ended. Further, if the air blowing operation is being executed (S11: Yes), whether the movement of the sheet feed tray 236 in the opening and closing direction has been detected by the opening and closing movement detection sensor 403 described above is determined (S12-1). That is, since the opening and closing movement detection sensor 403 outputs a signal corresponding to the inclination of the sheet feed tray 236, the control portion 100 may detect the moving amount of the sheet feed tray 236 in the opening and closing direction based on the signal. If the moving amount is equal to or greater than a predetermined amount so as not to detect a slight vibration, for example, it is determined that the sheet feed tray 236 has moved in the opening and closing direction. If the movement of the sheet feed tray 236 in the opening and closing direction has not been detected by the opening and closing movement detection sensor 403 (S12-1: No), it is determined that the sheet feed tray 236 is at the opened position and not moved, and the air blow stop determination processing is ended.

Meanwhile, if the movement of the sheet feed tray 236 in the opening and closing direction is detected by the opening and closing movement detection sensor 403 (S12-1: Yes), it is a state in which the lifting of the sheet feed tray 236 by the user has been detected. Therefore, the control portion 100 stops the above-mentioned fan motors 511M and 512M (refer to FIG. 2) to stop the air blowing operation to the sheets S (S13), and the air blow stop determination processing is ended.

Even if the air blowing operation is stopped as described above, there may be a case where the lifting plate detection sensor 402 is OFF, that is, the sheet feed tray 236 is at the opened position (S4-1: No, S8-1: No). In that case, according to the second embodiment, the feeding operation is performed continuously without executing the air separating operation by blowing air (S6). That is, if the air blowing operation is carried out in a state where the sheet feed tray 236 is lifted, the second sheet may be conveyed beyond the position of the side edge regulation plates 511 and 512 by air, as described above, and may be inclined. However, since the air blowing operation is stopped, the inclination of sheets may be reduced, the occurrence of skewing may be reduced, and the occurrence of jamming of sheets may be reduced while continuing feeding of sheets.

Therefore, in the sheet feed control according to the second embodiment, before a predetermined time has elapsed after starting the air blowing operation (S5: No), the sheet feed tray 236 is moved in the opening and closing direction, for example by the user (S3-1, S12-1: Yes). Then, the air blowing operation is stopped (S13). Therefore, even if the feeding operation (S6) is continued, it may be possible to reduce the occurrence of skewing of the sheet S caused by the misalignment of position of the sheet S, and the occurrence of jamming of sheets may be reduced.

In the sheet feed control according to the second embodiment, after the feeding operation of the sheet S is started (S6), if the sheet feed tray 236 is moved in the opening and closing direction, for example by the user (S7-1, S12-1: Yes), the air blowing operation is stopped (S13). Therefore, similarly, even if the feeding operation (S6) is continued, it may be possible to reduce the occurrence of skewing of the sheet S caused by the misalignment of position of the sheet S, and the occurrence of jamming of sheets may be reduced.

Then, when it is detected that the lifting plate detection sensor 402 has been turned ON and the sheet feed tray 236 has been closed (S4-1: Yes, S8-1: Yes), the present sheet feed control is ended at that time without performing the feeding operation (S6). Therefore, in a case where the user has lifted the sheet feed tray 236 and moved the same to the closed position, the feeding operation of the sheet S is also stopped. Therefore, it becomes possible to prevent the feeding of sheets in a state where the sheet feed tray 236 is closed, which may cause jamming of sheets.

Summary of Second Embodiment

As escribed above, according to the sheet feed control of the second embodiment, a separating mode is executed in which the feeding of sheets is performed while executing the air blowing operation. In a case where the sheet feed tray 236 is moved in the opening and closing direction during execution of the separating mode, the air blowing operation is stopped, such that the inclination of the sheet S may be reduced, the occurrence of skewing of the sheet S may be reduced, and the occurrence of jamming of sheets may be reduced. Further, when the sheet feed tray 236 is closed, the feeding operation of the sheets S is stopped, and the occurrence of jamming of sheets may be reduced. Moreover, it becomes possible to prevent the continuation of the air blowing operation even after the sheet feed tray 236 has been closed and the feeding operation has been stopped, such that unnecessary power consumption may be cut down.

Other Embodiments

According to the first and second embodiments described above, an example has been described where the air blowing operation is stopped when the sheet feed tray 236 is lifted up, for example by a user. However, the present technique is not limited thereto, and for example, in a configuration where the sheet feed tray 236 may be opened stepwise, the air blowing operation may be stopped in a case where the sheet feed tray 236 is moved in the opening direction by the user after the starting of a job. As described, even in a case where the sheet feed tray 236 is opened during a job, the sheet may be moved from the set position and the position thereof may be misaligned by the air blowing operation, but the misalignment of the position of the sheet may be reduced by stopping the air blowing operation.

Further, according to the first embodiment, the lifting plate detection sensor 402 is described as an example of the sensor for detecting the movement of the sheet feed tray 236 in the opening and closing direction. Further, according to the second embodiment, the opening and closing movement detection sensor 403 is described as an example of the sensor for detecting the movement of the sheet feed tray 236 in the opening and closing direction. However, the present embodiment is not limited thereto, and any device may be used as long as the movement of the sheet feed tray 236 may be detected, such as detecting an angle of a rotation shaft that rotates along with the movement of the sheet feed tray 236 in the opening and closing direction by an encoder.

Further according to the first and second embodiments, the lifting plate detection sensor 402 is described as an example of a sensor for detecting the opening and closing of the sheet feed tray 236. However, the present technique is not limited thereto, and any system such as that utilizing a contact switch may be used, as long as the opening and closing of the sheet feed tray 236 with respect to the apparatus body 201A may be detected. Especially, as in the first embodiment, where one sensor may detect both the opening and closing of the sheet feed tray 236 and the movement thereof in the opening and closing direction, it is preferable that the output signal is varied when the sheet feed tray 236 has moved for a certain angle, i.e., predetermined angle.

Further according to the present embodiment, the image forming apparatus 201 is equipped with the control portion 100 and the manual sheet feed portion 235. However, the present technique is not limited thereto, and for example, the image forming apparatus may include a sheet feeding apparatus, such as a scanner having a structure in which sheets are supported manually and the supporting portion of the sheet is configured to move in the opening and closing direction with respect to the apparatus body, and which is equipped with a control portion. Further, the image forming apparatus is not limited to the image forming apparatus 201 according to the present embodiments, and it may be an image forming system equipped with a sheet feed deck.

According to the present embodiment, both the separating mode and the normal mode may be selectively executed. However, the present technique is not limited thereto, and it may be possible to adopt a configuration where only the separating mode is executed.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2023-035593, filed Mar. 8, 2023, which is hereby incorporated by reference herein in its entirety.

What is claimed is:

1. A sheet feeding apparatus comprising:
- an apparatus body;
- a sheet supporting portion provided on a side of the apparatus body and including a supporting surface configured to support a sheet, the sheet supporting portion being configured to move to:
  - a closed position closed with respect to the apparatus body; and
  - an opened position, which is opened with respect to the apparatus body, that is a sheet feeding position where the sheet supported on the supporting surface is feedable;
- a sheet feeding portion configured to feed a sheet supported on the supporting surface;
- a detection portion configured to detect a position of the sheet supporting portion;
- a blowing portion configured to blow air toward the sheet supported on the supporting surface; and
- a control portion configured to execute a blowing mode of performing an air blowing operation by the blowing portion in feeding the sheet by the sheet feeding portion, wherein, in the blowing mode, the control portion is configured to:
  - stop the air blowing operation in a case where a movement of the sheet supporting portion from the sheet feeding position toward the closed position is detected by the detection portion.

2. The sheet feeding apparatus according to claim 1, wherein, in the blowing mode, the control portion is configured to:
- start a feeding operation by the sheet feeding portion after starting the air blowing operation by the blowing portion; and
- stop the air blowing operation in a case where the detection portion has detected that the sheet supporting portion has moved from the sheet feeding position toward the closed position before the starting of the air blowing operation.

3. The sheet feeding apparatus according to claim 1, wherein, in the blowing mode, the control portion is configured to:
- start a feeding operation by the sheet feeding portion after starting the air blowing operation by the blowing portion; and stop the air blowing operation in a case where the detection portion has detected that the sheet supporting portion has moved from the sheet feeding position toward the closed position after the feeding operation has been started.

4. The sheet feeding apparatus according to claim 1, wherein the detection portion is a detection sensor configured to detect the opened position in which the sheet supporting portion is opened from the closed position.

5. The sheet feeding apparatus according to claim 4, wherein:

the sheet feeding portion includes:

a feed roller configured to feed the sheet supported on the supporting surface; and a roller supporting portion configured to support the feed roller movably among:

a contact position in contact with the sheet supported on the supporting surface;

a separated position separated from the sheet supported on the supporting surface; and a stored position stored in the apparatus body by having the sheet supporting portion closed, and the detection sensor is an on-off sensor, including a flag portion fixed to one of the roller supporting portion or the apparatus body, and a first signal output portion that is fixed to the other one of the roller supporting portion or the apparatus body, and that is configured to vary an output signal between a case where the flag portion is detected and a case where the flag portion is not detected.

6. The sheet feeding apparatus according to claim 1, wherein the detection portion is a position change detection sensor configured to change an output signal according to a moving amount of the sheet supporting portion.

7. The sheet feeding apparatus according to claim 6, wherein the position change detection sensor is a push sensor including a moving portion that is pressed by the sheet supporting portion and moved, and a second signal output portion that varies an output signal according to a position of the moving portion.

8. The sheet feeding apparatus according to claim 6, further comprising a detection sensor configured to detect the closed position in which the sheet supporting portion is closed with respect to the apparatus body and the opened position in which the sheet supporting portion is opened from the closed position.

9. The sheet feeding apparatus according to claim 1, further comprising:

a side edge regulation plate configured to move in a width direction orthogonal to a sheet feeding direction, and configured to regulate a position of the sheet supported on the supporting surface in the width direction, and wherein the blowing portion includes a fan, and a duct that guides air sent from the fan through an inner side of the side edge regulation plate and that blows air to a side of the sheet.

10. An image forming apparatus comprising:

a sheet feeding apparatus; and an image forming portion configured to form an image on a sheet fed by the sheet feeding apparatus, wherein the sheet feeding apparatus comprises:

an apparatus body;

a sheet supporting portion provided on a side of the apparatus body and including a supporting surface configured to support a sheet, the sheet supporting portion being configured to move to:

a closed position closed with respect to the apparatus body; and an opened position, which is opened with respect to the apparatus body, that is a sheet feeding position where the sheet supported on the supporting surface is feedable;

a sheet feeding portion configured to feed a sheet supported on the supporting surface;

a detection portion configured to detect a position of the sheet supporting portion;

a blowing portion configured to blow air toward the sheet supported on the supporting surface; and a control portion configured to execute a blowing mode of performing an air blowing operation by the blowing portion in feeding the sheet by the sheet feeding portion, wherein, in the blowing mode, the control portion is configured to:

stop the air blowing operation in a case where a movement of the sheet supporting portion from the sheet feeding position toward the closed position is detected by the detection portion.

* * * * *